United States Patent [19]

Perkins

[11] Patent Number: 4,607,846

[45] Date of Patent: Aug. 26, 1986

[54] GOLF CLUB HEADS WITH ADJUSTABLE WEIGHTING

[76] Inventor: Sonnie J. Perkins, 1214 169th Ave., NE., Bellevue, Wash. 98008

[21] Appl. No.: 730,194

[22] Filed: May 3, 1986

[51] Int. Cl.[4] ..... A63B 53/04; A63B 53/08

[52] U.S. Cl. ..... 273/171; 273/167 H; 273/77 A

[58] Field of Search ..... 273/171, 169, 172, 167 F, 273/167 H, 77 A

[56] References Cited

U.S. PATENT DOCUMENTS

| | | | |
|---|---|---|---|
| 1,840,924 | 1/1932 | Tucker | 273/171 |
| 3,064,980 | 11/1962 | Steiner | 273/171 |
| 3,979,122 | 9/1976 | Belmont | 273/171 |
| 4,043,563 | 8/1977 | Churchward | 273/171 |
| 4,145,052 | 3/1979 | Janssen et al. | 273/171 |

FOREIGN PATENT DOCUMENTS

| | | | |
|---|---|---|---|
| 413024 | 7/1934 | United Kingdom | 273/171 |
| 440379 | of 1935 | United Kingdom | 273/171 |

*Primary Examiner*—George J. Marlo
*Attorney, Agent, or Firm*—William W. Haefliger

[57] ABSTRACT

An improved weighting system is provided in combination with a golf club head having a front face adapted to strike a golf ball, a bottom surface, a top surface, an aft surface, a toe, a heel and a hosel, the system comprising (a) a first elongated opening extending directionally between the toe and heel, angled forwardly and rearwardly, and located closer to the head bottom surface than to said top surface, and a first weight adjustably located endwise in said opening, (b) and a second elongated opening extending directionally between the toe and heel, and located closer to said top surface than to said bottom surface and a second weight adjustably located endwise in that opening.

Also an auxiliary elongated opening may be provided in the head to intersect the heel and extend toward the hosel, and an auxiliary weight may be adjustably located in that opening; a weight carrying recess in the back side of the head is typically intersected by the first and second openings, and the openings may be oriented to provide adjustable weighting in fore and aft directions, as is disclosed.

20 Claims, 8 Drawing Figures

2
2
3
3
4
4
10
11
12
13
14
14a
14b
15
15a
16
17
18
18a
19
21
22
23
23a
24
26
30
33
40
40a
40c
42
43

11
11a
12
13
14
14a
14b
16
17
22
24

11
11a
13
18
23
30
33

11
11a
12
15
16
18
22
30
43

GOLF CLUB HEADS WITH ADJUSTABLE WEIGHTING

BACKGROUND OF THE INVENTION

This invention relates generally to golf clubs, and more particularly to selective weighting of golf club heads, as in a set, to impart desired swing-feel and ball flight result relationships to the individual clubs in the set.

It is well known that different golfers have different requirements as respects golf clubs best suited to their techniques of play. Vertical club head approach angles and/or arcs, plus horizontal swing path directions and club head surface speed all combine with impact location to effect accuracy, ball flight characteristics and distance. Good golfers achieve accuracy and ball flight characteristics by their superior stroke patterns and faster stroke swing speed. Poor golfers tend to lack both and, for instance, tend to need lower weight position in the head for better trajectory results, i.e., high weight position in a head tends to keep the ball down.

Golf club makers have attempted to provide weighting characteristics to help different type golfers; however, such attempts lack the unusual advantages in structure function and result now afforded by the present invention.

Golf club makers can vary club characteristics and make tests on machines, attempting to show such clubs to be properly designed with respect to weight distribution for proper shot results. But such a correlation is accurate only for the machine impact patterns and the machine stroke, not for golfers who are similar in appearance and appear machine-like in personal swing habits but who are human in their mental and physical applications. Thus, golfers vary in emotional perception of each shot affecting their physical effort and end result. It should theoretically be possible for a golfer to find a perfect "fitting" club that worked just as he desired; however, because clubs are generally designed esthetically in sets for marketing purposes, each golfer cannot find a set of clubs each of which matches perfectly his own psychological and physical expectations. It is applicant's experience that it is not currently feasible, if possible at all, to find or assemble such a matched conventional set of clubs. Those that attempt to acheieve such a matched set do so with great effort and expense through trial and error, physical adjustment, and weight distribution modification.

Even so called "custom clubs" utilize conventionally designed club heads, shafts and grips, which results in a subjectively determined set of "conventional" clubs. The latter are based on the custom club fitter's personal fit and matching assumptions, not resulting from the golfer's actual shot/result requirements or with superior result adjustability.

In the past, attempts were made to affix weights to golf club heads so that club weighting could be adjusted by the golfer in an attempt to strike a golf ball or balls to best advantage. See for example U.S. Pat. No. to Bowser (440,379) in 1935, and U.S. Pat. No. to Belmont (3,979,122) issued in 1976, to Churchward (4,043,563) issued in 1977, and to Janssen (4,145,052) issued in 1979. However, no way was known to selectively adjust the weighting of golf club heads in multiple and different modes, so as to achieve desired ball travel and desired swing-feel relationships of clubs in a set, with heads typically having different ball striking face angularity.

In this regard, the unique and advantageous methods and structures of the present invention were not known.

SUMMARY OF THE INVENTION

It is a major object of the invention to provide an improved golf club head, and weighting system for heads (thus the club in general) in a set, overcoming the above problems and difficulties, and providing universal weight adjustability and club-to-golfer fitting capability. Basically, the improved head has a front face, top and bottom surfaces, rear surface, toe, heel and hosel, and comprises (a) a first elongated opening extending directionally between the toe and heel, and located closer to the bottom surface than to the top surface, and a first weight adjustably located endwise in that opening, (b) and a second elongated opening extending directionally between the toe and heel, and located closer to the top surface than to the bottom surface, and a second weight adjustably located endwise in that second opening.

In addition, the head may include:

(c) an auxiliary elongated opening extending directionally parallel to the axis of the hosel and centrally located inside the extension of the hosel and intersecting with the heel, and an auxiliary weight adjustably located endwise in the auxiliary opening.

Accordingly, weights may be shifted in three dimensions in the head, toe and heel, at different elevations on the head and in the fore and aft directions, and weights of different density characteristics and number and as respects the different fore and aft locations of the upper and lower openings, are usable.

As will be seen, the holes may intersect the outer peripheries of the head, as at mouths at the toe and heel, and means may be provided to close such mouths after proper adjustable positioning of the weights, lengthwise in the multiple openings and in response to swing-feel try-out by a player.

Further, one or more of the openings, which may be cylindrical, may intersect a recess sunk in the rear side of the head; the weights may have threaded interfit with the opening bores; and the bores and mouths may be sealed, to be capable of being re-opened.

Finally, the head may comprise an iron or a wood.

These and other objects and advantages of the invention, as well as the details of an illustrative embodiment, will be more fully understood from the following specification and drawings in which:

DRAWING DESCRIPTION

DETAILED DESCRIPTION

Figure 1:
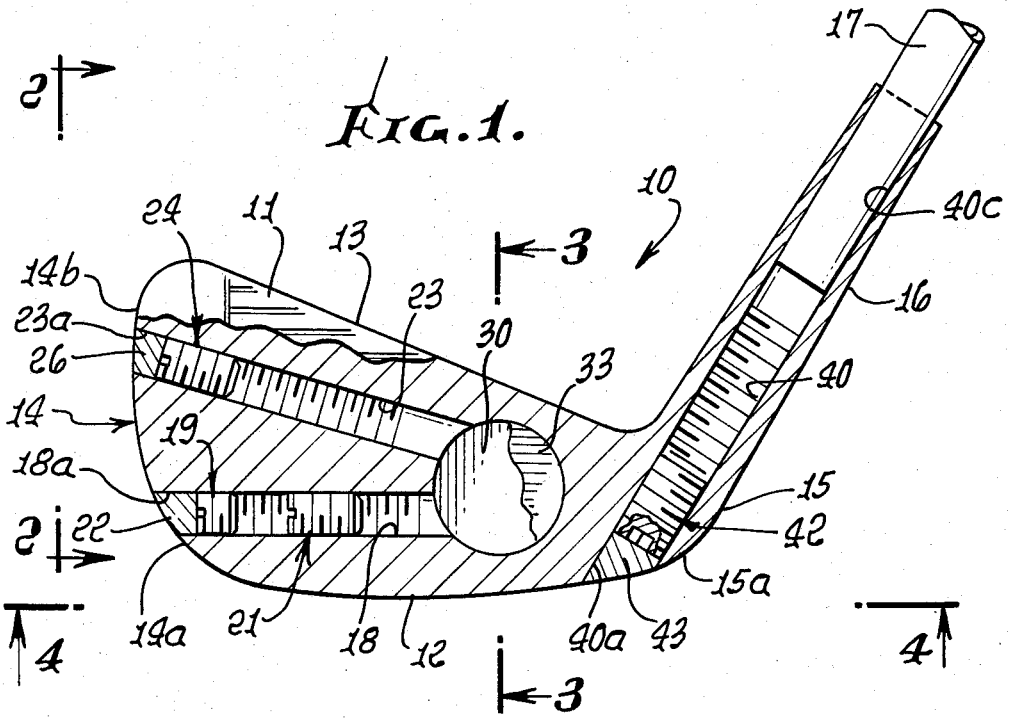
FIG. 1 is an elevational view of a golf club head incorporating the invention, and cut away to show interior construction.
Figure 2:
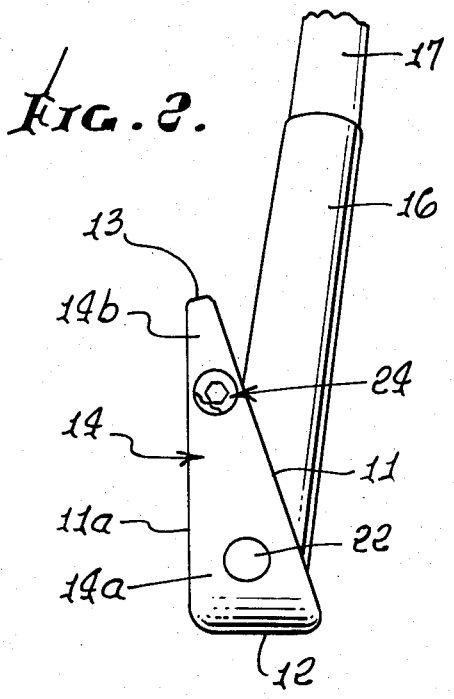
FIG. 2 is a vertical elevation taken on lines 2—2 of FIG. 1.
Figure 3:
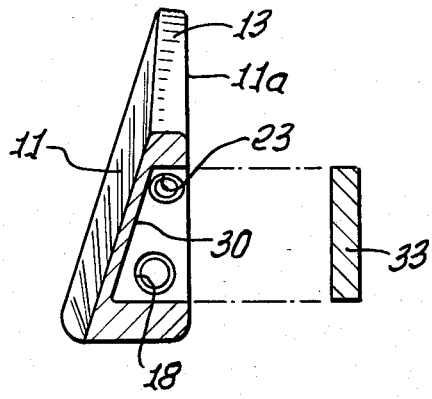
FIG. 3 is a vertical section taken on lines 3—3 of FIG. 1.
Figure 4:
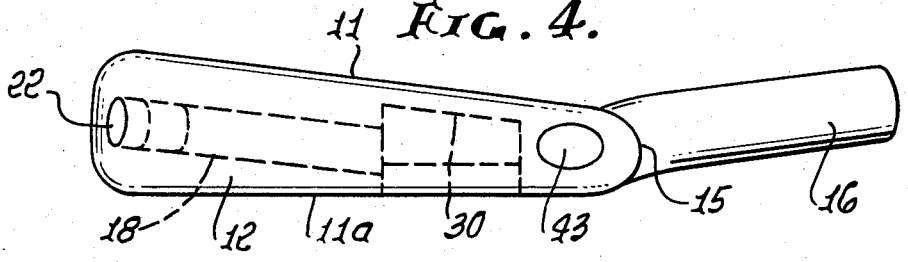
FIG. 4 is a bottom plan view taken on lines 4—4 of FIG. 1.

In the drawings, the golf club head 10 in the form of an iron has a front face 11 adapted to strike a golf ball, a rear surface 11*a* , a bottom surface 12, an angled top surface or edge 13, a toe 14, heel 15 and a hosel 16. A club shaft 17 is suitably attached to the hosel.

Figure 5:
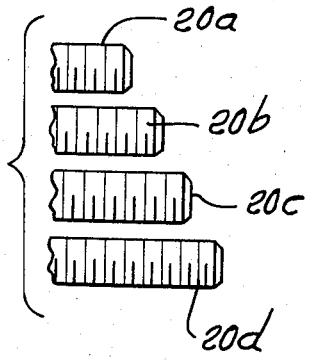
FIG. 5 shows multiple weights of different lengths usable in head openings.

In accordance with the invention, multiple linear openings are formed in the head at different elevations, and also in relation to the hosel. As shown, a first elongated opening 18 extends directionally between the tow and heel, and typically terminates at a mouth 18*a* at the toe surface 14*a*. Opening 18 is located closer to head bottom surface 12 than to surface 12. A first weight 19 is adjustably located endwise in the opening 18, and may be cylindrical and relatively tightly threaded into that opening so as not to be rotatable therein when the head strikes a golf ball. The opening is shown as threaded along most of its length, to allow extensive endwise adjustment of the weight, or multiple weights therein, or longer weights. See the different threaded weight sizes and lengths at 20*a*–20*d*, FIG. 5, which are selectively usable in opening 18. Also, they may have different lateral densities perpendicular to the threaded axis. Merely by way of example, a second weight is shown at 21 in opening 18, and spaced from weight 19. The mouth 18*a* is closed or sealed as by means of a suitable sealant 22 such as epoxide, or other material. Before such sealing, the weights are adjusted in one or more of the various openings (described and to be described) to provide the best swing-weight feel to the golfer, and the best ball travel and alignment control.

A second elongated opening 23 also extends directionally between the toe and heel, and typically terminates at a mouth 23*a* at toe surface 14*b*, above the level of mouth 18*a*. Opening 23 is located closer to head upper surface or edge 13 than to surface 12. Another weight 24 is adjustably located endwise in the opening 23, and may be cylindrical and relatively tightly thread fitted in the opening, but forcibly rotatable to move lengthwise therein, to selected position. The mouth 23*a* is closed or sealed, as by means of sealant 26. Such material may extend from an outer surface flush with toe curved surface into proximity to the weight, as is also the case with sealant 22 and weight 19. The position of weight 24 may be adjusted prior to sealing of the mouth 23*a*, and more than one weight, or weights of selected lengths, may be provided in opening 23. The densities of the various weights in the openings 18 and 23 may also be varied (as by different metal densities,— i.e. brass, steel, aluminum and alloys, etc.) to achieve desired club swing feel, and ball travel and alignment control (length, stopping characteristics and direction for example). Also, the diameter of openings 18 and 23 may differ. Since opening 23 is angled upwardly, the head center of gravity may be elevated, simply by rotating weight 24 to move towards mouth 23*a*. Also, opening 18 is angled forwardly, and aft, so that forward or aftward weight adjustment is achieved.

A recess 30 is sunk in the rear side 31 of the head, closer to heel 15 than to toe 14. The recess is sized to be intersected by both openings 18 and 23. Weighting material may be located in and suitably affixed in that recess, as indicated for example at 33. The opening may be left unplugged, to lighten the club head at that location.

An auxiliary elongated opening 40 extends directionally upwardly and at an angle from vertical, toward and into the hosel, i.e., in the axial direction of the shaft 17. It terminates at a mouth at heel surface 15*a*, proximate bottom surface level of the head. Opening 40 is shown as cylindrical and as a continuation of the shaft receiving opening 40*c* in the hosel. A further weight 42 is adjustably located in opening 40, but forcibly rotatable to move lengthwise therein, to a selected position. The mouth is closed, or sealed, as by removable sealant material 43 as for example epoxide or other material, the seal surface 43*a* extending with curvature that is flush with heel surface curvature, as shown.

The position of weight 43 may be adjusted lengthwise, i.e., up or down in the opening 40, and more than one weight may be employed, as described with respect to 19 and 21 in opening 18. Also, weight diameters and lateral density characteristics may vary. Such opening 40 extends upwardly, the head center of gravity may be raised or lowered by weight position adjustment 25 in opening 40, and more or less weight may be concentrated at the heel.

Figure 6:
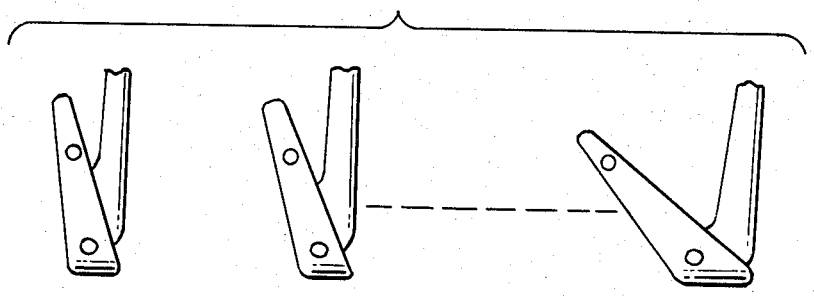
FIG. 6 shows a club set.
Figure 7:
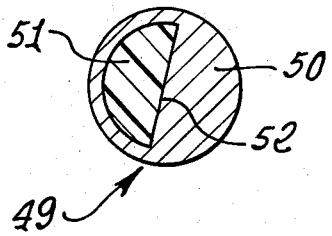
FIG. 7 and 8 show different weights.
Figure 8:
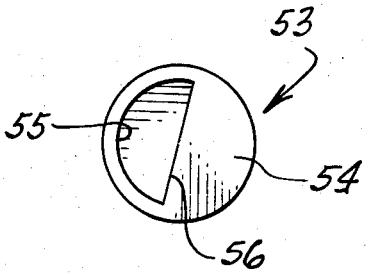

As shown from the above, the weights in all three openings may be selected and adjusted to provide an infinite number of possible head weight adjustments, in multiple dirctions, i.e. endwise of the head between toe and heel, up and down in the outer part of the head, i.e. near the toe, and up and down at the heel and hosel end of the head and forwardly and rearwardly between surfaces 11 and 11*a*. FIG. 7 shows a modified weight 49 with metal 50 and plastic 51 at opposite sides of diameter plane 56; and FIG. 8 shows a modified weight 53 with metal 54 and a recess 55 on opposite sides of diameter plane 56. When either of the weights 49 and 53 is used and rotated, the weight center of gravity is shifted forwardly or rearwardly (between surfaces 11 and 11*a*) as the weight moves lengthwise of its opening. Such center of gravity is offset from the weight axis of rotation. The player may thereby more extensively and accurately adjust all the heads in a complete set, indicated in FIG. 6. to obtain best swing-feel, and ball control for all the clubs in the set, and he may change such adjustments by removing the sealant and rotating the weight or weights and replacing the sealant. The latter may for example comprise an epoxide material.

It will be noted that circular weight 33 has a diameter much greater than its thickness, providing for substantial weight variation at the location of recess 33; thus, for example, the weight may consist of materials having densities equal to or greater than steel, or substantially less than steel. Also, the thickness of that weight may be varied greatly, and its fore and aft position in recess 33 may be varied, to adjust the weight fore and aft, and the amount of such weight. It may be fastened in position as by adhesive material, at its periphery, and it is directly accessible at the rear of the head, for removal, adjustment and replacement. Also, its geometry and position can be adjusted to seal off the inner ends of the drilled openings 18 and 23, prior to which weighting material may be introduced into those openings, which may have reduced diameters relative to their diameters proximate the toe of the head, for additional weight adjustment.

I claim:

1. A golf club head having a front face adapted to strike a golf ball, a bottom surface, a top surface, an aft surface, a toe, a heel and a hosel, comprising (a) a first elongated opening extending directionally between the lower extents of the toe and heel, and located closer to said bottom surface than to said top surface, said first opening also angled forwardly and aftwardly, and a first weight adjustably located endwise in said opening, (b) and a second elongated opening extending directionally between the toe and heel, and located closer to said top surface than to said bottom surface, said second opening inclined upwardly relative to the first opening and toward the upper extent of the toe, and a second weight adjustably located endwise in said opening.

2. The golf club head of claim 1 wherein said openings intersect the outer periphery of the head at opening mouths, and including means in said openings closing said mouths.

3. The golf club head of claim 2 wherein at least one of the weights consists of a metal which is different than the material of said head.

4. The golf club head of claim 1 wherein said openings and weights have interengaged screw threads, whereby the weights may be adjustably displaced endwise in said openings in response to rotation of the weights.

5. The golf club head of claim 1 wherein said weights have selected lengths, and are shorter than said openings.

6. The golf club head of claim 1 including (a) an auxiliary elongated opening extending directionally parallel to the hosel and intersecting said heel, and an auxiliary weight adjustably located endwise in said auxiliary opening, said first and second openings terminating at a recess sunk in the rear side of the head and everywhere spaced from said auxiliary opening.

7. The golf club head of claim 6 wherein said auxiliary opening extends in a neck defined by the head.

8. The golf club head of claim 6 wherein there are at least two weights in at least one of said openings.

9. A set of golf club irons, each as defined in claim 1, the weights in said heads of the irons selectively adjusted in said openings.

10. The golf club head of claim 1 wherein there are at least two weights in said openings.

11. A golf club head having a front face adapted to strike a golf ball, a bottom surface, a top surface, an aft surface, a toe, a heel and a hosel, comprising (a) a first elongated opening extending directionally between the toe and heel, and located closer to said bottom surface than to said tops surface, and a first weight adjustably located endwise in said opening, (b) and an auxiliary elongated opening extending directionally parallel to the hosel and intersecting said heel and an auxiliary weight adjustably located endwise in said auxiliary opening, (c) said first opening having an end which intersects a recess sunk in the rear side of the head, and there being a plug in the recess, said recess closer to said heel than to said toe, but spaced from said auxiliary opening.

12. The golf club head of claim 11 wherein said openings intersect the outer periphery of the head at opening mouths, and including means in said openings closing said mouths.

13. The golf club head of claim 11 wherein said openings and weights have interengaged screw threads, whereby the weights may be adjustably displaced endwise in said openings in response to rotation of the weights.

14. The golf club head of claim 13 wherein at least one of the weights consists of a metal which is different than the material of said head.

15. The golf club head of claim 11 wherein said weights have selected lengths, and are shorter than said openings.

16. The golf club head of claim 1 wherein said openings are cylindrical, and intersect the outer periphery of the head at the toe end thereof.

17. The golf club head of claim 16 wherein one end of each of said openings intersects a recess sunk in the rear side of the head closer to said heel than to said toe.

18. The golf club head of claim 17 including weighting material in said recess, the weighting material having a diameter greater than its thickness, and the recess having a depth greater than said weighting material thickness to permit fore and aft selected positioning of said weighting material.

19. The golf club head of claim 11 wherein said openings are cylindrical, and said first opening intersects the periphery of the head at the toe end thereof.

20. The golf club head of claim 11 wherein there are at least two weights in at least one of said openings.

* * * * *